US007786682B2

(12) United States Patent
Ikeda et al.

(10) Patent No.: US 7,786,682 B2
(45) Date of Patent: Aug. 31, 2010

(54) DISCHARGE LAMP LIGHTING CONTROL METHOD, COMPUTER PROGRAM, DISCHARGE LAMP LIGHTING CONTROL APPARATUS, AND POWER SUPPLY CIRCUIT

(75) Inventors: Tetsuro Ikeda, Osaka (JP); Kenzo Danjo, Osaka (JP); Hiroki Morimoto, Osaka (JP)

(73) Assignee: Sansha Electric Manufacturing Co., Ltd., Osaka (JP)

( * ) Notice: Subject to any disclaimer, the term of this patent is extended or adjusted under 35 U.S.C. 154(b) by 229 days.

(21) Appl. No.: 12/138,838

(22) Filed: Jun. 13, 2008

(65) Prior Publication Data

US 2008/0315790 A1 Dec. 25, 2008

(30) Foreign Application Priority Data

Jun. 25, 2007 (JP) ..... 2007-166901

(51) Int. Cl.
*G05F 1/00* (2006.01)

(52) U.S. Cl. ..... 315/291; 315/247; 315/276; 315/307; 315/224

(58) Field of Classification Search ..... 315/247, 315/246, 224, 225, 209 R, 291, 297, 307–311, 315/276

See application file for complete search history.

(56) References Cited

U.S. PATENT DOCUMENTS

| | | | | |
|---|---|---|---|---|
| 6,853,155 | B2 * | 2/2005 | Yamamoto et al. | 315/291 |
| 7,323,824 | B2 * | 1/2008 | Brates et al. | 315/224 |
| 2006/0132044 | A1 * | 6/2006 | Takahashi et al. | 315/46 |
| 2006/0261748 | A1 * | 11/2006 | Nukisato et al. | 315/291 |
| 2008/0111975 | A1 * | 5/2008 | Okamoto et al. | 353/85 |
| 2009/0278469 | A1 * | 11/2009 | Yamada et al. | 315/291 |

FOREIGN PATENT DOCUMENTS

JP H07-176391 A 7/1995

* cited by examiner

*Primary Examiner*—Tuyet Thi Vo
(74) *Attorney, Agent, or Firm*—Global IP Counselors, LLP

(57) ABSTRACT

Lighting of a discharge lamp is controlled in a manner to reduce deterioration of the discharge lamp subjected to high temperature and extend the lifetime of the discharge lamp. A method for controlling lighting of the discharge lamp includes a first constant current control process (period T1, which corresponds to steps S3 and S4) in which constant current control is executed by supplying a first current to the discharge lamp, a second constant current control process (period T3, which corresponds to steps S7 and S8) in which constant current control is executed by supplying a second current greater than the first current to the discharge lamp after the first constant current control process, and a constant power control process (period T4) in which constant power control is executed after the second constant current control process.

11 Claims, 3 Drawing Sheets

DISCHARGE LAMP LIGHTING CONTROL METHOD, COMPUTER PROGRAM, DISCHARGE LAMP LIGHTING CONTROL APPARATUS, AND POWER SUPPLY CIRCUIT

BACKGROUND OF THE INVENTION

1. Field of the Invention

The present invention relates to a method for controlling lighting of a discharge lamp, and more particularly, to a method for controlling lighting of a discharge lamp with which constant current control is executed before constant power control. The present invention further relates to a computer program, an apparatus for controlling lighting of a discharge lamp, and a power supply circuit.

2. Description of the Related Art

Discharge lamps are categorized either as low-pressure discharge lamps or high-pressure discharge lamps depending on the pressure of their discharge gases. High-pressure discharge lamps may be further categorized as xenon lamps, high-pressure mercury lamps, or metal halide lamps. A metal halide lamp is a high-pressure discharge lamp in which metal halides are added to an arc discharge formed in high-pressure mercury vapor.

In a stable lighting status, discharge lamps are normally controlled through constant power control, with which the lamps consume less power. However, during a few-minute period after insulation breakdown, high-pressure discharge lamps, such as metal halide lamps, have a low lighting voltage, and therefore are required to be controlled through constant current control. More specifically, the high-pressure discharge lamps are controlled first through constant current control, and then are shifted to constant power control when their voltage reaches a predetermined value.

During the period after insulation breakdown before shifting to the constant power control, the high-pressure discharge lamps may overshoot or undershoot. Overshooting is the phenomenon in which a large current flows through a discharge lamp immediately after insulation breakdown. Undershooting is the phenomenon in which a small current flows through the discharge lamp as a reaction to overshooting. The discharge lamp may overshoot due to a delay in its control circuit or due to a capacitance of its smoothing circuit. When the discharge lamp overshoots, an excessively large current may flow through the lamp. This will damage the electrodes of the lamp. When the discharge lamp undershoots, the voltage of the lamp may decrease below a voltage at which an arc discharge can be maintained. This will turn off the lamp.

To prevent the discharge lamp from overshooting and undershooting, the reference current value, which serves as a target current of the lamp, may be increased in stages until the current of the lamp reaches a value at which the steady lighting is started (see, for example, Japanese Unexamined Patent Publication No. H7-176391).

DISCLOSURE OF THE INVENTION

Technical Problem

With the conventional discharge lamp lighting control method, the same reference current value is used in an arc starting period and a lamp startup period (period immediately before the lighting voltage increases to a predetermined value). In this case, the temperature of the electrodes may increase instantaneously in the arc starting period. This will cause two problems. One problem is as follows. The thermal expansion coefficient of glass sealing the lamp and the thermal expansion coefficient of wires connected to the electrodes differ greatly from each other. Due to the large difference between the thermal expansion coefficients of the glass and the wires, the sealing portion of the lamp may deteriorate when subjected to heat, and may fail to maintain the hermetically sealed state of the lamp. In this case, high-pressure gas enclosed in the glass tube leaks out. This will shorten the lifetime of the lamp. The other problem is as follows. The electrodes of the lamp may melt when the temperature of the electrodes increases instantaneously. This will shorten the lifetime of the lamp further.

It is an object of the present invention to control lighting of a discharge lamp in a manner to reduce deterioration of the discharge lamp subjected to high temperature and extend the lifetime of the discharge lamp.

Technical Solution

A first aspect of the present invention provides a method for controlling lighting of a discharge lamp. The method includes a first constant current control process in which constant current control is executed by supplying a first constant current to the discharge lamp, a second constant current control process in which constant current control is executed by supplying a second constant current greater than the first constant current to the discharge lamp after the first constant current control process, and a constant power control process in which constant power control is executed after the second constant current control process.

With this method, the first constant current control process is performed before the second constant current control process. This prevents the temperature of the electrodes of the discharge lamp from increasing instantaneously during startup, and consequently extends the lifetime of the discharge lamp.

A second aspect of the present invention provides the method of the first aspect of the present invention in which the first constant current is 50 to 70% of the second constant current.

With this method, the first constant current is set at a small value. In this case, the discharge lamp can overshoot only at a level that would not cause any problems in the lamp.

A third aspect of the present invention provides the method of one of the first and second aspects of the present invention in which the first constant current is equivalent to a minimum current at which an arc is formed.

With this method, an arc is formed in a reliable manner in the first constant current control process.

A fourth aspect of the present invention provides the method of one of the first to third aspects of the present invention in which the constant current control is executed for 1 to 2 seconds in the first constant current control process.

With this method, an arc is formed in a reliable manner and is further stabilized in the first constant current control process.

A fifth aspect of the present invention provides the method of one of the first to fourth aspects of the present invention further including a changing current control process in which a current that increases with time is supplied to the discharge lamp between the first constant current control process and the second constant current control process.

With this method, the electrodes of the discharge lamp are heated gradually. This prevents the temperature of the electrodes from increasing instantaneously.

A sixth aspect of the present invention provides the method of the fifth aspect of the present invention in which the current supplied in the changing current control process increases linearly or increases in a stepwise manner.

With this method, the electrodes of the discharge lamp are heated gradually. This prevents the temperature of the electrodes from increasing instantaneously.

A seventh aspect of the present invention provides the method of one of the fifth and sixth aspects of the present invention in which the current is supplied for 8 to 12 seconds in the changing current control process.

With this method, the current increases from the first current to the second current with appropriate time.

An eighth aspect of the present invention provides the method of one of the first to seventh aspects of the present invention in which the constant current control is executed for 5 to 10 seconds in the second constant current control process.

With this method, the discharge lamp has sufficient time to stabilize its voltage.

A ninth aspect of the present invention provides a computer program including a command that causes a computer to implement the method of one of the first to eighth aspects of the present invention.

This program has the same advantageous effects as the method described above.

A tenth aspect of the present invention provides an apparatus for controlling lighting of a discharge lamp including the computer program of the ninth aspect of the present invention.

The apparatus implementing the computer program has the same advantageous effects as the method described above.

An eleventh aspect of the present invention provides the apparatus of the tenth aspect of the present invention further including a storage unit for storing a plurality of power characteristic values used with the method in correspondence with a plurality of ratings of lamps.

This apparatus reads a power characteristic corresponding to each discharge lamp with a different rating from its storage unit, and implements the discharge lamp lighting control method in a manner suitable for each discharge lamp. More specifically, the apparatus eliminates such cases in which a large current flows through a lamp that has a small rating and damages the lamp or a small current flows through a lamp that has a large rating and fails to properly form an arc in the lamp.

A twelfth aspect of the present invention provides a power supply circuit including an inverter, and the apparatus according to one of the tenth and eleventh aspects of the present invention for controlling the inverter.

The power supply circuit reads a power characteristic corresponding to each discharge lamp with a different rating from its storage unit, and implements the discharge lamp lighting control method in a manner suitable for each discharge lamp. More specifically, the power supply circuit eliminates such cases in which a large current flows through a lamp that has a small rating and damages the lamp or a small current flows through a lamp that has a large rating and fails to properly form an arc in the lamp.

ADVANTAGEOUS EFFECTS

According to the present invention, a first constant current control process is performed before a second constant current control process to prevent the temperature of the electrodes of a discharge lamp from increasing instantaneously during startup, and consequently extends the lifetime of the discharge lamp.

BEST MODE FOR CARRYING OUT THE INVENTION

Figure 1:
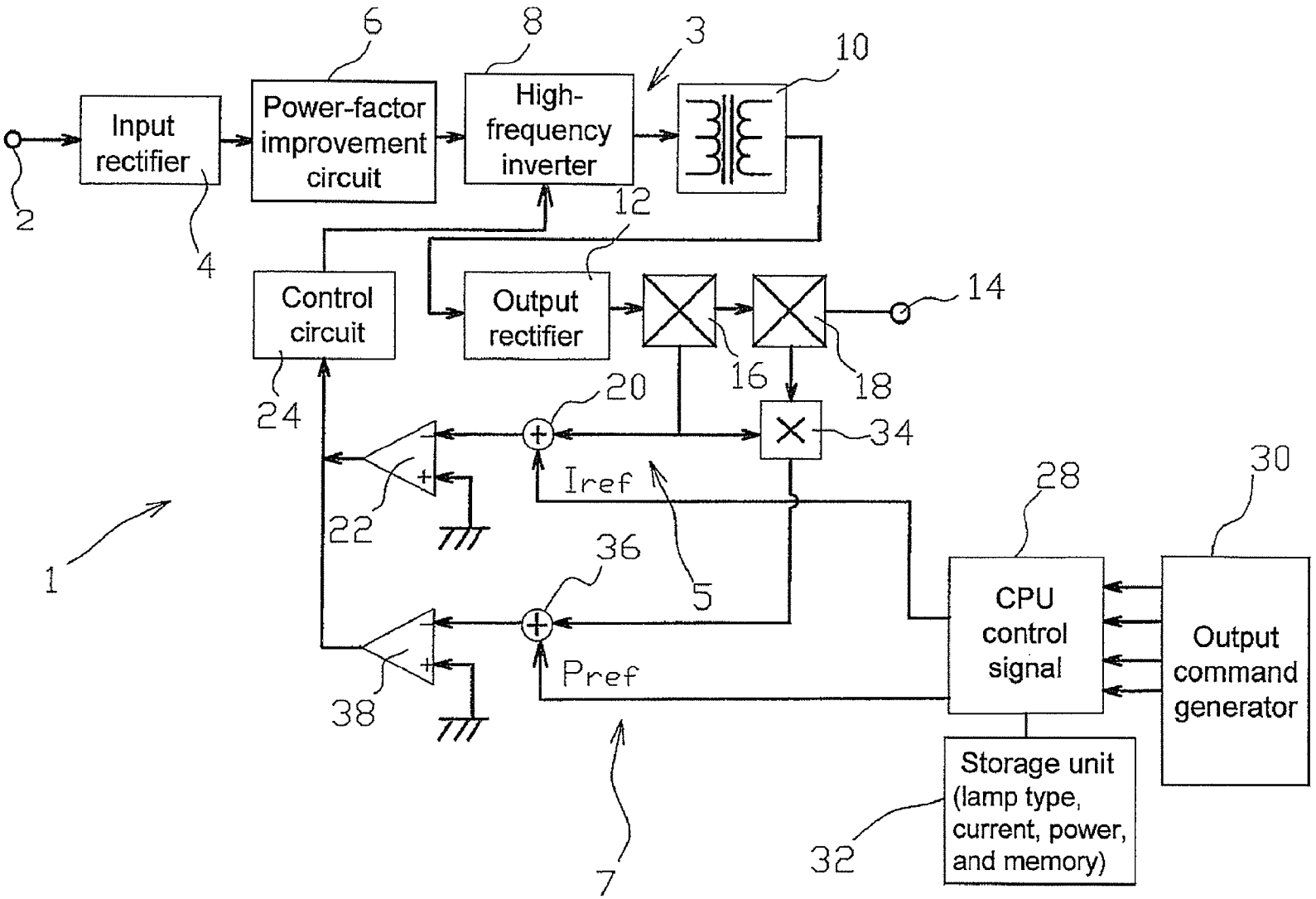
FIG. 1 is a circuit block diagram of a power supply for a light source according to an embodiment of the present invention.

FIG. 1 shows a power supply apparatus 1 according to an embodiment of the present invention. The power supply apparatus 1 controls lighting of a high-pressure discharge lamp, such as a metal halide lamp. The power supply apparatus 1 has an input terminal 2 and an output terminal 14. An AC (alternating current) voltage is input into the input terminal 2 from a commercial AC power supply. A direct voltage is output from the output terminal 14 to a discharge lamp (not shown). The power supply apparatus 1 includes an input rectifier 4, a power-factor improvement circuit 6, a high-frequency inverter 8, a transformer 10, and an output rectifier 12, which are arranged in the stated order between the input terminal 2 and the output terminal 14.

The input rectifier 4 rectifies and smoothes the AC voltage to generate a DC (direct current) voltage.

The high-frequency inverter 8 is a DC to high-frequency converter, which converts a DC voltage to a high-frequency voltage. The high-frequency inverter 8 includes a plurality of semiconductor switching elements. The semiconductor switching elements may be, for example, insulated gate bipolar transistors (IGBTs), power field-effect transistors (FETs), or bipolar transistors. The semiconductor switching elements are rapidly switched on and off repeatedly in response to a control signal provided from a control circuit 24 (described later), and convert a DC signal to a high-frequency signal. The transformer 10 lowers an input high-frequency voltage to generate a predetermined high-frequency voltage. The output rectifier 12 is a high-frequency to DC converter, which converts a high-frequency voltage to a DC voltage. The high-frequency inverter 8, the transformer 10, and the output rectifier 12 function as a DC to DC converter 3.

A constant current control unit 5 will now be described. The constant current control unit 5 controls the operation of the high-frequency inverter 8. The constant current control unit 5 includes a current detector 16, a first adder 20, a first error amplifier 22, the control circuit 24, a CPU 28, and a storage unit 32.

The current detector 16 is connected between the output rectifier 12 and the output terminal 14. The current detector 16 generates a load current detection signal (for example, a load current detection voltage) indicating a DC (load current), which is generated by the output rectifier 12 and supplied to the discharge lamp. The load current detection voltage generated by the current detector 16 is provided to the first adder 20. The first adder 20 is further provided with a reference voltage from the CPU 28. As the reference voltage, the CPU 28 reads a current value corresponding to each of the lamp periods T1 to T3 stored in the storage unit 32, and provides the current value to the first adder 20. The first adder 20 calculates a difference between the load current detection voltage and the reference voltage, and provides the calculated value to the first error amplifier 22. More specifically, the calculated value is provided to a negative input terminal of the first error amplifier 22. A positive input terminal of the first error amplifier 22 is set at a reference potential, which is a ground potential for example. In this case, an output signal (for example, an output voltage) of the first error amplifier 22 is an inverted signal of the output voltage of the first adder 20.

The output voltage of the first error amplifier 22 is provided to the control circuit 24. The control circuit 24 controls the conducting states of the semiconductor switching elements of the high-frequency inverter 8 in a manner that the input voltage of the first error amplifier 22 will be zero, that is, the load current detection voltage of the current detector 16 will be equal to the reference voltage from the CPU 28.

A constant power control unit 7 will now be described. The constant power control unit 7 controls the operation of the high-frequency inverter 8. The constant power control unit 7 includes the current detector 16, a voltage detector 18, a multiplier 34, a second adder 36, a second error amplifier 38, the control circuit 24, the CPU 28, and an output command generator 30.

The voltage detector 18 is connected between the output rectifier 12 and the output terminal 14. The voltage detector 18 generates a load voltage detection signal (for example, a load voltage detection voltage) indicating a DC voltage (load voltage), which is generated by the output rectifier 12 and supplied to the discharge lamp. The load voltage detection voltage generated by the voltage detector 18 is provided to the multiplier 34. The load current detection voltage generated by the current detector 16 is also provided to the multiplier 34. The multiplier 34 multiplies the two voltage values to generate a load power indicating signal (for example, a load power indicating voltage) indicating the load power, and provides the load power indicating signal to the second adder 36. The second adder 36 is also provided with a constant power reference voltage, which serves as a lamp constant power reference signal, from the CPU 28. The CPU 28 provides the reference voltage to the second adder 36 by following a command generated by the output command generator 30. The second adder 36 calculates a difference between the load power indicating voltage and the reference voltage, and provides the calculated value to the second error amplifier 38. More specifically, the calculated value is provided to a negative input terminal of the second error amplifier 38. A positive input terminal of the second error amplifier 38 is set at a reference potential, which is a ground potential for example. In this case, an output signal (for example, an output voltage) of the second error amplifier 38 is an inverted signal of the output voltage of the second adder 36.

The output voltage of the second error amplifier 38 is provided to the control circuit 24. The control circuit 24 controls the conducting states of the semiconductor switching elements of the high-frequency inverter 8 in a manner that the input voltage of the second error amplifier 38 will be zero, that is, the load power detection voltage from the multiplier 34 will be equal to the constant power reference voltage provided from the CPU 28.

As described above, the power supply apparatus 1 controls lighting of the high-pressure discharge lamp, which is for example a metal halide lamp. More specifically, the power supply apparatus 1 controls lighting of the high-pressure discharge lamp first through constant current control and then through constant power control. The power supply apparatus 1 controls lighting of the lamp in this manner for the reasons described below. A xenon lamp is formed by, for example, arranging a positive electrode and a negative electrode to face each other with a space of several millimeters between them in a glass tube, and enclosing xenon gas in the glass tube with a pressure of several atmospheres. When a constant current is applied between the positive and negative electrodes of the xenon lamp, an arc discharge is formed between the distal ends of the positive and negative electrodes. The lamp then enters a stable lighting status. When the xenon lamp is used for a long period of time until its lifetime is almost expired, the positive and negative electrodes may wear, or the pressure in the glass tube may decrease to increase the impedance of the xenon lamp. As a result, a larger voltage may be applied to the xenon lamp in the stable lighting status. In this case, the xenon lamp consumes more power. In other words, the xenon lamp generates more heat. This may cause the positive and negative electrodes of the lamp to melt. One technique known in the art to overcome this problem is to reduce the current flowing through the xenon lamp and reduce power consumption when a voltage equal to or greater than a predetermined reference value is applied to the xenon lamp. As one example of this technique, the xenon lamp shifts to constant power control to reduce the current flowing through the lamp when its output voltage increases to or above the reference voltage.

The current control and the constant power control of the lamp will now be described with reference to FIG. 2.

Figure 2:
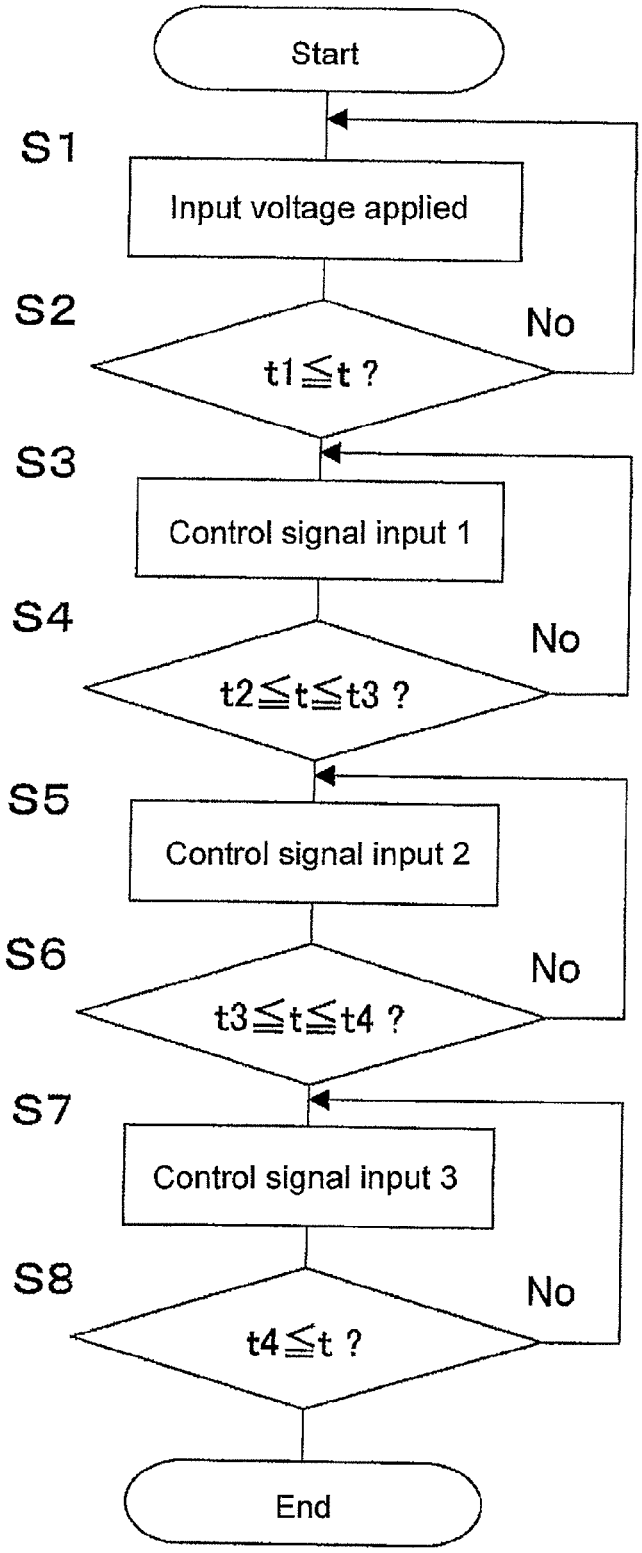
FIG. 2 is a flowchart illustrating a discharge lamp lighting control operation according to the embodiment of the present invention.
Figure 3:
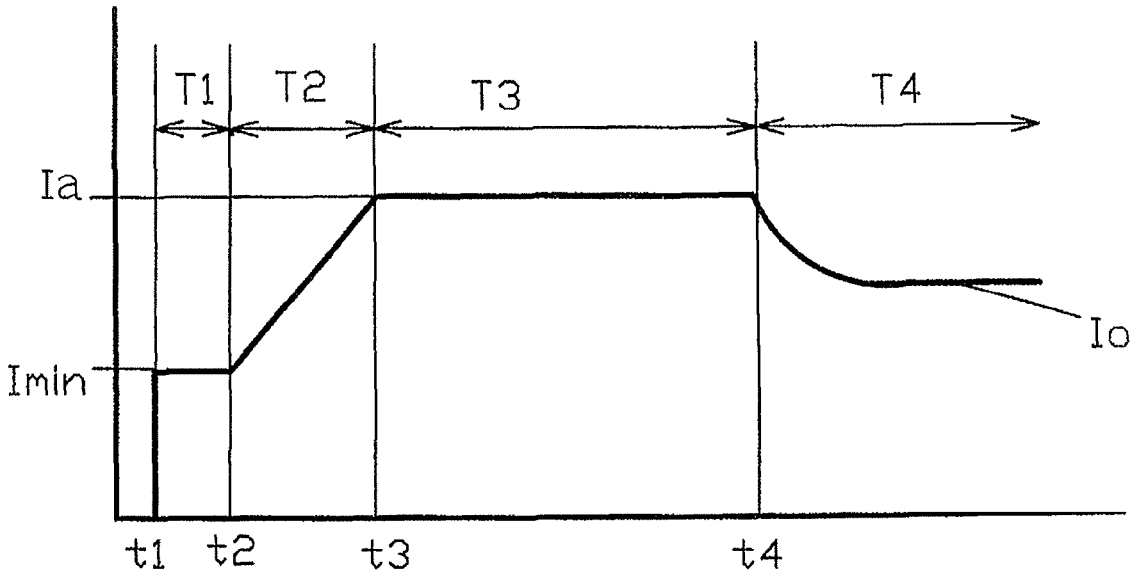
FIG. 3 is a graph of the lamp current as a function of time showing the discharge lamp lighting control operation according to the embodiment of the present invention.

FIG. 2 is a flowchart illustrating a current control operation of the lamp performed during startup according to the embodiment of the present invention. FIG. 3 is a graph showing temporal changes of the lamp current Io. The power supply apparatus 1 has a computer program including commands that cause a computer to implement the discharge lamp control method described below. Table 1 shows the current reference value $I_{ref}$ and the power reference value $P_{ref}$ of a lamp (with a power rating of 1 kW) corresponding to periods T1 to T4 (described later). The storage unit 32 stores the values shown in Table 1. The storage unit 32 stores sets of these values for different types of lamps.

TABLE 1

| Lamp Type | | T1 | T2 | T3 | T4 |
|---|---|---|---|---|---|
| 1 kW | Iref | 25 A | 5 A/sec | 50 A | 50 A |
| | Pref | 1 kW | 1 kW | 1 kW | 1 kW |

The current control of the lamp will first be described briefly with reference to the flowchart shown in FIG. 2.

In step S1 in FIG. 2, an input voltage is applied to the lamp (t1 in FIG. 3). Subsequently in step S2, the lamp waits until timing t1. A timing t1, a control signal is input into the lamp (control signal input 1) in step S3. As a result, a current (Imin) flows through the lamp. In step S4, the lamp waits until the period T1 elapses. After the period T1 (t2 in FIG. 3), a control signal is input into the lamp (control signal input 2) in step S5. As a result, the value of the current flowing through the lamp changes linearly from Imin to Ia. In step S6, the lamp waits until the period T2 elapses. After the period T2 (t3 in FIG. 3), a control signal is input into the lamp (control signal input 3) in step S7. As a result, the constant current control of the lamp starts. In step S8, the lamp waits until the period T3 elapses. After the period T3, the constant current control of the lamp ends.

The shifting from the current control to the constant power control will be described in detail with reference to the graph shown in FIG. 3.

The period T1 is a period from timing t1, at which insulation breakdown occurs, to timing t2, at which an arc is stabilized. In the period T1, the CPU 28 provides a reference voltage indicating a reference current (for example, 25 A) for the period T1, which is read from the storage unit 32, to the first adder 20. The first adder 20 calculates a difference between the load current detection voltage and the reference voltage, and provides the calculated value to the first error amplifier 22. The first error amplifier 22 provides its output voltage to the control circuit 24. The control circuit 24 controls the conducting states of the semiconductor switching elements of the high-frequency inverter 8 in a manner that the load current detection voltage of the current detector 16 will be equal to the reference voltage provided from the CPU 28.

The period T2 starts from timing t2 and is a period during which the current value increases linearly. In the period T2, the CPU 28 provides a reference voltage to the first adder 20 based on a current increasing rate (for example, 5 A/sec) with which the reference current read from the storage unit 32 for the period T2 increases. The first adder 20 calculates a difference between the load current detection voltage and the reference voltage, and provides the calculated value to the first error amplifier 22. The first error amplifier 22 provides its output voltage to the control circuit 24. The control circuit 24 controls the conducting states of the semiconductor switching elements of the high-frequency inverter 8 in a manner that the load current detection voltage of the current detector 16 will be equal to the reference voltage provided from the CPU 28. The periods T1 and T2 correspond to a startup period of the lamp.

The period T3 is a period from timing t3, at which the arc is stabilized, to timing t4, at which the lighting voltage of the lamp reaches a predetermined voltage. In the period T3, the CPU 28 provides a reference voltage indicating a reference current for the period T3, which is read from the storage unit 32 (for example, 50 A), to the first adder 20. The first adder 20 calculates a difference between the load current detection voltage and the reference voltage, and provides the calculated value to the first error amplifier 22. The first error amplifier 22 provides its output voltage to the control circuit 24. The control circuit 24 controls the conducting states of the semiconductor switching elements of the high-frequency inverter 8 in a manner that the load current detection voltage of the current detector 16 will be equal to the reference voltage provided from the CPU 28.

The period T4 is a steady lighting period, during which the discharge lamp is controlled through the constant power control. During the period T4, the discharge lamp is usable for various purposes. In the period T4, the CPU 28 provides the reference voltage (for example, a signal indicating a power rating of 1 kW) to the second adder 36 by following a command generated by the output command generator 30. The second adder 36 calculates a difference between the load power indicating voltage and the reference voltage, and provides the calculated value to the second error amplifier 38. The second error amplifier 38 provides its output voltage to the control circuit 24. The control circuit 24 controls the conducting states of the semiconductor switching elements of the high-frequency inverter 8 in a manner that the input voltage of the second error amplifier 38 will be zero, that is, the load power indicating voltage from the multiplier 34 will be equal to the constant power reference voltage provided from the CPU 28.

In FIG. 3, Imin indicates the minimum value of the current at which an arc can be formed, and Ia indicates the reference value of the current flowing through the lamp during the period T3, which is a period immediately before the voltage of the lamp is stabilized.

As one example, when the reference current value Ia is 100 A in the period T2, the reference current value Imin during startup is set at a value of as small as about 60 A. In this case, even if the discharge lamp overshoots, no problem occurs in the lamp. A rated current of 33 A flows through a lamp that has a power of 500 W. A rated current of 180 A flows through a lamp that has a power of 7 KW. These lamps would have favorable performance when Imin=0.6*Ia. The period T2 (t2 to t3) is about 10 seconds. The period T3 (t3 to t4) is 5 to 10 seconds. The period T1 (t1 to t2) is 1 to 2 seconds.

Advantageous Effects

A method of the present invention for controlling lighting of a discharge lamp includes a first constant current control process (period T1, which corresponds to steps S3 and S4) in which constant current control is executed by supplying a first current to the discharge lamp, a second constant current control process (period T3, which corresponds to steps S7 and S8) in which constant current control is executed by supplying a second current greater than the first current to the discharge lamp after the first constant current control process, and a constant power control process (period T4) in which constant power control is executed after the second constant current control process.

With this method, the first constant current control process is performed before the second constant current control process. This prevents the temperature of the electrodes of the discharge lamp from increasing instantaneously during startup, and consequently extends the lifetime of the discharge lamp.

It is preferable that the first current Imin is in a range of 50 to 70% of the second current Ia. The first constant current is set at a small current value. In this case, even if the discharge lamp overshoots, no problem occurs in the lamp.

The first current Imin is equivalent to a minimum current value at which an arc is formed. In this case, an arc is formed in a reliable manner in the first constant current control process.

It is preferable that the constant current control is executed for 1 to 2 seconds in the first constant current control process. In this case, an arc is formed in a reliable manner and is farther stabilized in the first constant current control process.

It is preferable that the method further includes a changing current control process (period T2, which corresponds to steps S5 and S6) in which a current that increases with time is supplied to the discharge lamp between the first constant current control process and the second constant current control process. In this case, the electrodes of the discharge lamp are heated gradually. This prevents the temperature of the electrodes from increasing instantaneously.

It is preferable that the current supplied in the changing current control process increases linearly or increases in a stepwise manner. In this case, the electrodes of the discharge lamp are heated gradually. This prevents the temperature of the electrodes from increasing instantaneously.

It is preferable that the current is supplied for 8 to 12 seconds in the changing current control process. In this case, the current increases from the first current to the second current with appropriate time.

It is preferable that the constant current control is executed for 5 to 10 seconds in the second constant current control process. In this case, the discharge lamp has sufficient time to stabilize its voltage.

The storage unit 32 further stores a plurality of power characteristic values used with the method in correspondence with a plurality of ratings of lamps. In this case, a power characteristic corresponding to each discharge lamp with a different rating is read from the storage unit, and the discharge lamp lighting control method is implemented in a manner suitable for each discharge lamp. More specifically, the method eliminates such cases in which a large current flows through a lamp that has a small rating and damages the lamp or a small current flows through a lamp that has a large rating and fails to properly form an arc in the lamp.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention is provided for illustration only, and not for the purpose of limiting the invention as defined by the appended claims and their equivalents.

What is claimed is:

1. A light control apparatus for controlling lighting of a discharge lamp in supplying current including a first and second constant currents, the light control apparatus comprising:

a control device being configured to supply the first constant current to the discharge lamp between when insulation breakdown occurs and when arc is stabilized, the first constant current being the minimum current to occur the insulation breakdown, the control device being configured to supply the second constant current greater than the first constant current to the discharge lamp after when the are is stabilized until when lighting voltage of the lamp reaches a predetermined level, the control device being configured to control the discharge lamp under constant power after the lighting voltage reaches the predetermined level.

2. The light control apparatus according to claim 1, wherein the discharge lamp is controlled under the constant power for 1 to 2 seconds.

3. The light control apparatus according to claim 1, wherein the control device is configured to supply the second constant current to the discharge lamp for 5 to 10 seconds.

4. The light control apparatus according to claim 1, further comprising:

a storage unit configured to store a plurality of power characteristic values used in correspondence with a plurality of ratings of lamps.

5. A power supply circuit, comprising:

an inverter; and the light control apparatus according to claim 1 for controlling the inverter.

6. The light control apparatus according to claim 1, wherein the first constant current is 50 to 70% of the second constant current.

7. The light control apparatus according to claim 6, wherein the discharge lamp is controlled under the constant power for 1 to 2 seconds.

8. The light control apparatus according to claim 6, further comprising:

the control device is configured to increase the current as time elapses a changing to the discharge lamp from the first constant current to the second constant current.

9. The light control apparatus according to claim 1, wherein:

the control device is configured to increase the current as time elapses to the discharge lamp from the first constant current to the second constant current.

10. The light control apparatus according to claim 9, wherein the control device is configured to increase the current linearly or increases in a stepwise manner to the discharge lamp from the first constant current to the second constant current.

11. The light control apparatus according to claim 9, wherein the control device is configured to increase the current for 8 to 12 seconds to the discharge lamp from the first constant current to the second constant current.

* * * * *